US009545816B2

(12) United States Patent
Pluth et al.

(10) Patent No.: US 9,545,816 B2
(45) Date of Patent: Jan. 17, 2017

(54) SYSTEM AND METHOD FOR A FRAME ASSEMBLY

(71) Applicant: Tara Materials, Inc., Lawrenceville, GA (US)

(72) Inventors: James Pluth, San Diego, CA (US); David Twite, Buford, GA (US)

(73) Assignee: Tara Materials, Inc., Lawrenceville, GA (US)

( * ) Notice: Subject to any disclaimer, the term of this patent is extended or adjusted under 35 U.S.C. 154(b) by 0 days.

(21) Appl. No.: 14/809,034

(22) Filed: Jul. 24, 2015

(65) Prior Publication Data

US 2016/0214428 A1 Jul. 28, 2016

Related U.S. Application Data

(60) Provisional application No. 62/108,104, filed on Jan. 27, 2015.

(51) Int. Cl.

| | |
|---|---|
| ***B44D 3/18*** | (2006.01) |
| ***B41F 15/36*** | (2006.01) |
| ***D06C 3/08*** | (2006.01) |

(52) U.S. Cl.

CPC ..... *B44D 3/185* (2013.01); *B41F 15/36* (2013.01); *B44D 3/18* (2013.01); *D06C 3/08* (2013.01)

(58) Field of Classification Search

CPC ..... D06F 59/00; B41F 15/34; B41F 15/36; H05K 3/1225; E06B 9/52; E06B 2009/527; B44D 3/185; B44D 3/18; E04H 15/64; D05C 1/02; D05C 9/04; G09F 15/0025; D06C 3/08

See application file for complete search history.

(56) References Cited

U.S. PATENT DOCUMENTS

| | | | | |
|---|---|---|---|---|
| 3,273,497 A * | 9/1966 | Rosema | ..... | B41F 15/36 101/128.1 |
| 3,805,873 A | 4/1974 | Bloomfield | | |
| 3,848,380 A | 11/1974 | Assael | | |
| 3,950,869 A * | 4/1976 | Samarin | ..... | B44D 3/185 160/378 |
| 4,153,981 A | 5/1979 | Stuppy | | |

(Continued)

FOREIGN PATENT DOCUMENTS

BE 1020901 A3 8/2014

OTHER PUBLICATIONS

International Search Report and Written Opinion of the International Searching Authority issued for International Application No. PCT/US2016/014846 dated Apr. 22, 2016.

*Primary Examiner* — Ismael Izaguirre
(74) *Attorney, Agent, or Firm* — Charles F. Reidelbach, Jr.

(57) ABSTRACT

A kit and method for assembling a frame supporting a stretched sheet includes a set of four stretcher bars, a set of braces, a stretching lever, and a sheet of material. A first stretcher bar can be initially attached to a first edge of the sheet. Remaining second, third, and fourth stretcher bars can be assembled with the first stretcher bar and corner braces to form a frame that rests upon the sheet. The stretching lever can be used to stretch the sheet between opposing stretcher bars just before the sheet is attached to a stretcher bar. The method of using a stretching lever as opposed to stretching pliers greatly reduces the time and difficulty of uniformly stretching the sheet.

21 Claims, 17 Drawing Sheets

(56) References Cited

U.S. PATENT DOCUMENTS

| | | | | |
|---|---|---|---|---|
| 4,181,046 | A * | 1/1980 | Lamb | B25B 7/00 140/123.5 |
| 4,341,255 | A * | 7/1982 | Mock | E06B 3/28 160/368.1 |
| 4,403,642 | A | 9/1983 | Morris | |
| 4,566,236 | A * | 1/1986 | Pound | A01G 9/1415 160/354 |
| 4,676,016 | A | 6/1987 | Phillips et al. | |
| 6,722,096 | B2 * | 4/2004 | Von Arx | E04B 9/303 160/378 |
| 7,178,281 | B2 * | 2/2007 | Johansson | G09F 15/0025 38/102.91 |
| 8,453,566 | B2 * | 6/2013 | Niswonger | B41F 15/34 101/127.1 |
| 8,495,828 | B1 * | 7/2013 | Feldman | B25B 7/123 294/16 |
| 2009/0217557 | A1 * | 9/2009 | Serrano | B44D 3/185 38/102.4 |
| 2010/0147471 | A1 | 6/2010 | Bull | |
| 2014/0352184 | A1 | 12/2014 | Hall | |

* cited by examiner

SYSTEM AND METHOD FOR A FRAME ASSEMBLY

CROSS-REFERENCE TO RELATED APPLICATION

This application claims the benefit of U.S. Provisional Application Ser. No. 62/108,104 filed on Jan. 27, 2015 and which is incorporated herein by reference.

FIELD OF THE INVENTION

The present invention concerns a system and method for assembling a frame with a stretched sheet. More particularly the present system and method improve quality and efficiency of properly stretching and assembling a sheet of material such as canvas to a frame.

BACKGROUND

Assembling a frame with a stretched sheet of material such as canvas can be a labor intensive process. Perhaps the most time-consuming part of this process is stretching the sheet itself. This is because putting a proper uniform tension in the sheet is an iterative process that can take hours even for a skilled artisan. For someone less skilled this can be a difficult and frustrating process. There is a need for an efficient way for assembling such frames that can be performed without special skill.

DETAILED DESCRIPTION OF THE PREFERRED EMBODIMENTS

Figure 1:
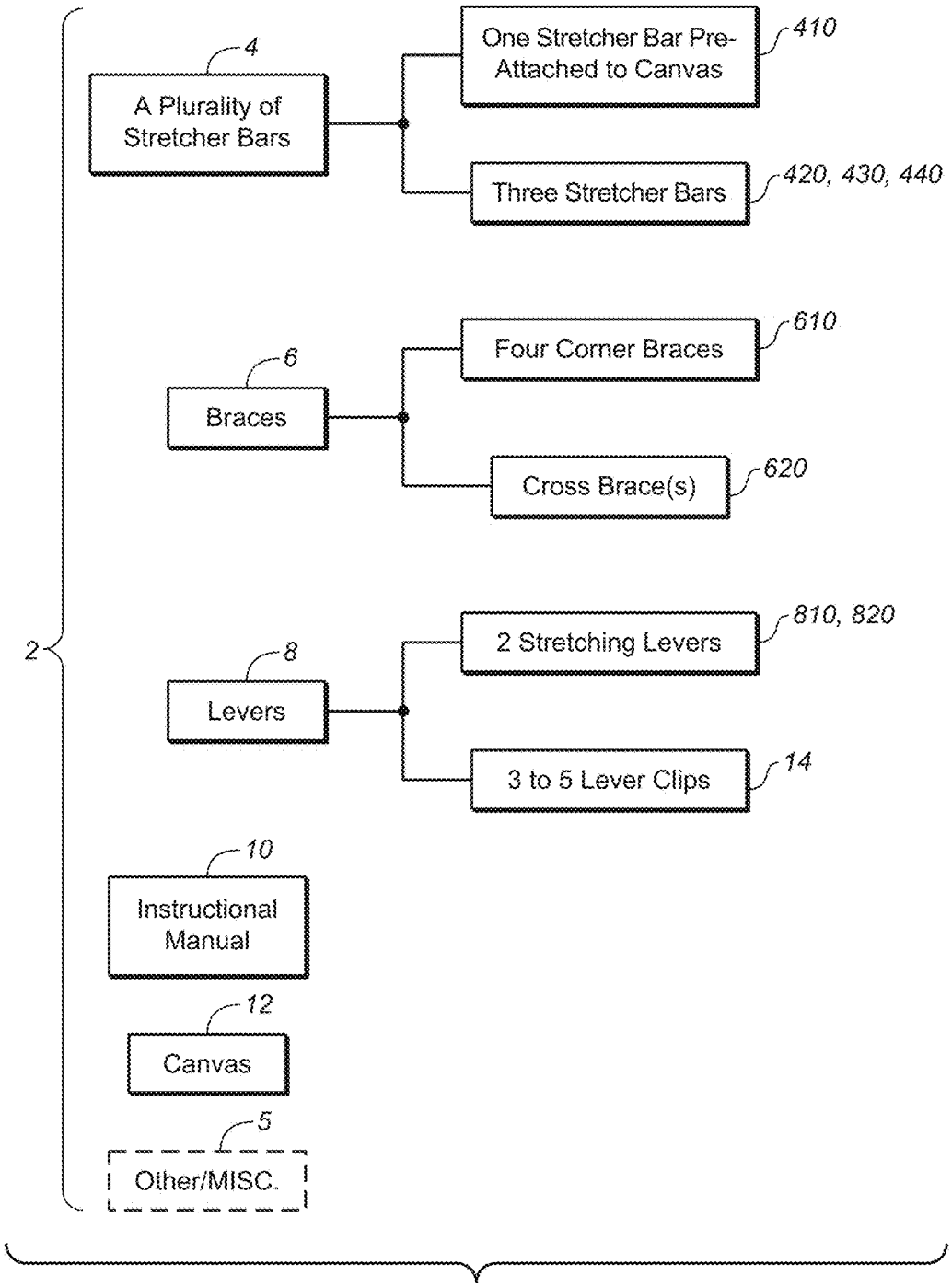
FIG. 1 is a block diagram representing an exemplary kit to be used for assembling a canvas supporting frame.

In a first aspect of the disclosure, a kit for assembling a frame with a stretched sheet is disclosed. The kit includes a set of stretcher bars, a set of braces, a stretching lever, and a sheet of material. The stretcher bars can be assembled into a frame. The frame can be placed over the sheet. The stretching lever can then be used in cooperation with the sheet and the stretcher bars to properly tension and fasten the sheet to the frame in an efficient and effective manner. In one embodiment the sheet of material is a canvas sheet. In other embodiments the sheet can be composed of a natural fiber, a polymer, or a composite of multiple layers. In various other embodiments the sheeted material may include one or more layers of vinyl, paper, polyethylene fiber, olefin fibers, and/or nylon to name a few examples. In another embodiment the sheet is pre-painted or printed before assembling the frame. In a further embodiment the sheet is blank before assembly and then printed or painted after assembly.

In one implementation the set of stretcher bars includes four stretcher bars including first, second, third, and fourth stretcher bars to be assembled end to end to form a rectangular frame. The first and third stretcher bars define opposite sides of a square or rectangular frame. Each stretcher bar has a lower surface to be disposed upon the sheet during assembly and an opposing upper surface. The third stretcher bar defines a vertical surface that faces the first stretcher bar. The stretching lever has opposing upper and lower edges. The lower edge of the stretching lever is to be placed against the vertical surface to provide a fulcrum. The upper edge of the stretching lever is to be attached to an edge of the sheet. Rotation of the upper edge of the stretching lever about the fulcrum and toward the first stretcher bar tensions the sheet along a direction that is perpendicular to a major axis of the third stretcher bar. In an exemplary embodiment the upper surface of the third stretcher bar defines a "lever recess" that includes the vertical surface.

In another implementation, a first one of the stretcher bars is pre-attached to one edge of the sheet to facilitate a more rapid assembly of the frame. In an alternative embodiment a user initially attaches an edge of the sheet to a first stretcher bar.

In a further implementation the set of stretcher bars includes four stretcher bars including first, second, third, and fourth stretcher bars. Each of the stretcher bars defines a major bar axis. Each stretcher bar includes two connecting ends disposed at opposing ends relative to the major bar axis. The connecting ends allow the stretcher bars to be mutually connected at the connecting ends to define a frame. In one embodiment the connecting ends mutually connect with a tongue and groove structure. In an alternative embodiment the connecting ends mutually connect with a miter joint.

In yet another implementation each stretcher bar defines three mutually perpendicular axes including a major bar axis, an intermediate bar axis, and a minor bar axis. Viewing a stretcher bar along the major axis after assembly into a frame, each stretcher bar has a lower surface against a sheet and an opposing upper surface. The lower surface defines a rounded extending portion over which the sheet is to be stretched. The upper surface defines a "lever recess" including an lever recess vertical surface and a lever recess horizontal surface. The stretching lever defines three mutually perpendicular axes including a major lever axis, an intermediate lever axis, and a minor lever axis. The stretching lever has an upper edge and a lower edge at opposing ends of the intermediate lever axis. The lower edge is for engaging the lever recess on a stretcher bar. The engagement between the lower edge and the lever recess forms a fulcrum for the stretching lever. An edge of the sheet is attached to the upper edge. The sheet is stretched by rotating the upper edge about the fulcrum. In one embodiment the kit includes a lever clip having a tapered notch. The sheet is secured to the upper edge when it is sandwiched between the tapered notch and the upper edge of the stretching lever. In another embodiment a length of the stretching lever along the major lever axis is nearly equal to the length of the lever recess along a major bar axis of the stretcher bar. This enables uniform stretching of the sheet. In a further embodiment the upper surface of the stretcher bar defines a brace recess between the lower surface and the lever recess. This brace recess can accommodate a brace such as a corner brace or a cross brace. In a yet further embodiment a corner brace includes opposing angular ends with each end for opposing the brace recess of adjacent stretcher bars. This engagement assures that the long axes of the adjacent stretcher bars are perpendicular.

In yet a further implementation the kit may include tools for assembling the frame. The tools may include one or more of a hammer, razor knife, needle nose pliers, staple puller, power driver, power stapler, tape measure, manual stapler, and/or a manual screwdriver. Alternatively the user may have a similar set of tools on hand before assembly.

In another aspect of the disclosure, a method for assembling the frame is disclosed. The method includes the following steps: (1) Disposing a square or rectangular sheet on a flat surface. In one embodiment a user attaches a first stretcher bar to a first edge of the sheet. In another embodiment a first stretcher bar is pre-attached to the first edge of the sheet. (2) First, second, third, and fourth stretcher bars are assembled in an end-to-end configuration to form a square or rectangular frame. The first and third stretcher bars form opposite sides of the frame and are thus in an opposing configuration. The second and fourth stretcher bars form opposite sides of the frame and are thus in an opposing configuration. Each stretcher bar has a lower surface to be disposed upon the sheet and an opposing upper surface. The third stretcher bar defines a vertical surface that faces the first stretcher bar. (3) Positioning a lower edge of a stretching lever against the vertical surface. Engagement between the lower edge of the stretching lever with the vertical surface defines a fulcrum for the stretching lever. In one embodiment the opposing upper surface of the third stretcher bar defines a lever recess that includes the vertical surface. Thus engagement between the lever recess and the lower edge of the stretching lever define the fulcrum for the stretching lever. (4) Attaching a third edge of the sheet to an upper edge of the stretching lever. In the preferred embodiment, attaching the third edge of the sheet includes wrapping the sheet over the upper edge of the stretching lever and then using a lever clip to attach the sheet to the upper edge of the stretching lever. The lever clip defines a tapered notch and wherein attaching the sheet to the upper edge of the stretching lever includes capturing the sheet between the tapered notch and the upper edge of the stretching lever. (5) Rotating the upper edge of the stretching lever toward the first stretcher bar to tension the sheet. The rotation is about the defined fulcrum. (6) Attaching the tensioned sheet to the third stretcher bar. In the preferred embodiment, the attachment means are staples or tacks.

In one implementation each stretcher bar includes a pair of complementary tongue and groove features at opposing ends and assembling the stretcher bars includes engaging the complementary tongue and groove features. In an alternative embodiment each stretcher bar includes a pair of complementary miter surfaces at opposing ends and assembling the stretcher bars includes engaging the complementary miter surfaces.

In another implementation each stretcher bar defines a brace recess and further comprising assembling a corner brace onto the brace recesses of two adjacent stretcher bars before positioning the lower edge of the stretching lever. The corner braces engage the brace recesses and assure that major axes of adjacent stretch bars are substantially perpendicular to each other.

In a further implementation each stretcher bar defines a brace recess horizontal surface and further comprising assembling a cross brace onto the brace recess horizontal surfaces of two opposing stretcher bars before positioning the lower edge of the stretching lever.

In yet a further implementation the frame is fully assembled with a stretched sheet before being (1) disassembled, (2) placed into compact packaging, and then (3) shipped to a customer or user. The ability of the frame to be assembled and disassembled in this manner allows for efficient use of space and less damage to the product during transportation. In one embodiment an image is painted or printed onto the sheet between assembly and disassembly. This provides a volume-efficient and cost-effective way to ship a painted or printed frame without damage.

In a further aspect of the disclosure an apparatus for assembling a frame includes an elongate stretcher bar defining three axes including a major bar axis, an intermediate bar axis, and minor bar axis. The stretcher bar has complementary connecting ends at opposing ends of the stretcher bar relative to the major axis to enable multiple stretcher bars to be connected in an end to end configuration. The stretcher bar has opposing lower and upper surfaces relative to the minor axis. The lower surface is for being placed against a sheet during the frame assembly. The upper surface defines a lever recess for receiving a lower edge of a stretcher bar during the frame assembly.

In one implementation the connecting ends are complementary tongue and groove features to allow two elongate stretcher bars to be coupled at complementary connecting ends whereby the major axes of the two elongate stretcher bars are at right angles to each other.

In another implementation the lower surface defines a rounded portion extending downwardly, the rounded portion rests upon the sheet during assembly. When the sheet is tensioned, it is tensioned across the rounded portion.

In a further implementation the upper surface defines a brace recess horizontal surface for receiving an end of a brace before a use of the stretching lever. The brace recess horizontal surface is sufficiently below the lever recess whereby brace does not interfere with use of the stretching lever.

The disclosed kit is advantageous over a preassembled frame. By comparison, the kit can be packaged into a relatively small elongate box that occupies a smaller area and a smaller volume than an assembled frame. A disadvantage of shipping a fully assembled frame is also a likelihood of damage without very expensive packaging methods. The kit can be shipped with much less expensive packaging with less risk of damage. In addition to the less expensive packaging, the cost and energy required for shipping is also reduced.

The use of stretching levers in combination with stretcher bars has various advantages over the conventional use of pliers. Pliers only stretch along a limited length of the sheet. This results in an "iterative" approach to stretching that is time consuming, frustrating, and requires considerable skill to be effective. In contrast, the stretching levers of the disclosure enable a single stretching motion to replace the iterative stretching because stretching is performed over nearly the entire length of the stretcher bar at once. Additionally, the levers are less costly and lighter than pliers, allowing a fully functional kit to be lighter weight and lower cost. The lighter weight is reduces energy consumption and cost required for shipping.

The placement of the "lever recess" in the upper surface of the stretcher bar has an advantage that the stretching lever can be placed very close to an outer edge of the frame. This reduces an amount of sheet material required for attachment to the lever. Certain sheet materials can dominate the cost of the kit, so reducing the amount required is very helpful.

The use of the brace recess that is placed below the lever recess has certain advantages. The braces can be installed without interfering with the use of a straight stretching lever. An engagement between angular ends of the corner braces and vertical surfaces of the brace recess "squares up" adjacent stretcher bars thereby assuring that the major bar axes of adjacent stretcher bars are substantially perpendicular.

The following description includes the use of a canvas sheet for assembly of a canvas frame. It is to be understood that other sheet materials can be utilized in a similar manner and that the use of canvas as a sheet material is exemplary.

FIG. 1 is a block diagram depicting an exemplary embodiment of a kit 2 for assembling a canvas frame. Kit 2 includes a plurality of stretcher bars 4, braces 6, levers 8, instructions 10 and a sheet 12 such as a canvas sheet. An exemplary embodiment of kit 2 is illustrated with respect to FIG. 2. Kit 2 may include additional parts 5 such as screws, mounting brackets, power tools, and other items.

According to an exemplary embodiment: Stretcher bars 4 include one stretcher bar 410 that is pre-attached to a canvas sheet 12 and three stretcher bars 420, 430, and 440 that are initially separate. The stretcher bar 410 is properly placed upon and attached to sheet 12 using staples, tacks, glue or other adhesive material. Braces 6 include four corner braces 610 and one or more cross brace(s) 620. Levers 8 include two stretching levers 810 and 820. Lever clips 14 are also included to facilitate the use of levers 8.

Figure 2:
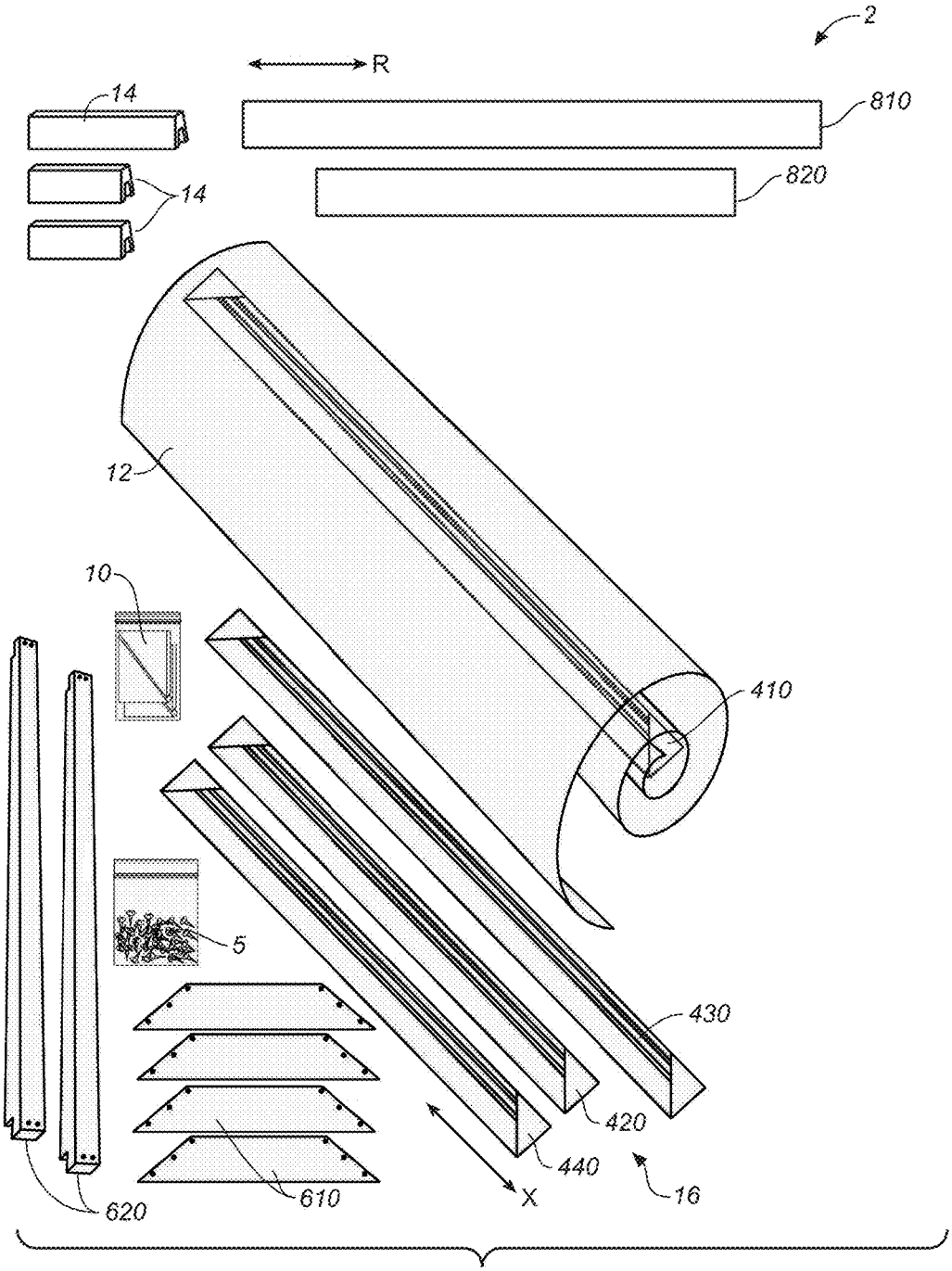
FIG. 2 is an illustrative representation of an exemplary kit to be used for assembling a canvas supporting frame.
Figure 3:
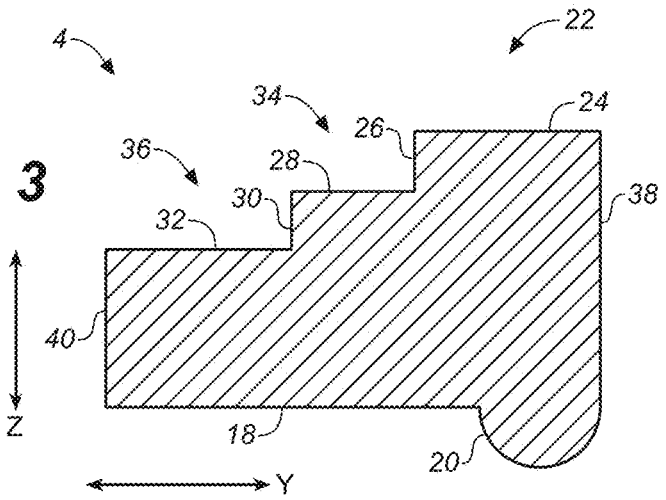
FIG. 3 is a cross sectional view of an exemplary stretcher bar that forms a portion of a canvas supporting frame.

Referring to FIGS. 2 and 3, each stretcher bar 4 defines three mutually perpendicular axes including a major bar axis X, an intermediate bar axis Y, and a minor bar axis Z. Relative to the major bar axis X there are two equal sized and relatively longer stretcher bars 410 and 430 and two equal sized and relatively shorter stretcher bars 420 and 440. Each stretcher bar 4 includes two connecting ends 16 on opposing ends with respect to major bar axis X.

In an alternative embodiment kit 2 may include a canvas sheet 12 that is separate from stretcher bar 410 (see FIG. 1). The canvas sheet 12 may be pre-cut to facilitate assembly. In yet another alternative embodiment all four stretcher bars 4 have an equal length as measured along major bar axis X so as to form a square frame. For a square frame, only one stretching lever 8 is required.

FIG. 3 is a cross section of a stretcher bar 4 taken between the connecting ends 16. Stretcher bar 4 has a lower surface 18 with a rounded extending portion 20. Canvas 12 is to be stretched across rounded extending portion 20.

Stretcher bar 4 has an upper surface 22 with top surface 24, lever recess vertical surface 26, lever recess horizontal surface 28, brace recess vertical surface 30, and brace recess horizontal surface 32. Lever recess vertical surface 26 and lever recess horizontal surface 28 together form a "lever recess" 34 that can be utilized for stretching the canvas sheet 12. Brace recess vertical surface 30 and brace recess horizontal surface 32 together define a "brace recess" 36 for receiving a brace 6. Brace recess 36 is positioned between lower surface 18 and lever recess 34 to allow a brace 6 to be attached to brace recess 36 without interfering with the use of the lever recess 34. Stretcher bar 4 also has an outer surface 38 that faces outwardly when a canvas frame is assembled.

In an exemplary embodiment the lever recess vertical surface 26 is about 0.25 inches in height. In other embodiments the lever recess vertical surface can be 3/16 of an inch or 5/16 of an inch in height or any value therebetween. Other vertical dimensions for lever recess vertical surface 26 are also possible but the aforementioned dimensions are preferable for some frame designs.

Stretcher bar 4 also includes an inner vertical surface 40. When stretcher bar 4 is assembled into a frame the inner vertical surface 40 inwardly faces an opposing stretcher bar 4. In an alternative embodiment vertical surface 40 can be used in place of the lever recess 34. This may require a stretching lever 8 with cutouts to avoid interference with corner braces 610 and cross braces 620. This is because the corner braces 610 and cross braces 620 are attached before a stretching operation takes place. A similar alternative embodiment is described with respect to FIGS. 14 and 15.

Figure 4:
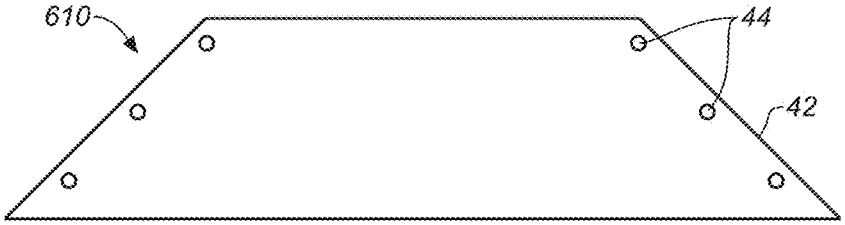
FIG. 4 is a top view of a corner brace for strengthening and squaring a canvas supporting frame.

Kit 2 includes four corner braces 610 and optionally at least one cross brace 620. A number and size of cross braces 620 can be partly dependent upon the size and geometry of a frame to be assembled. FIG. 4 depicts additional details of an exemplary embodiment of a corner brace 610. Each corner brace 610 has opposing angular ends 42 with screw holes 44.

Figure 5:
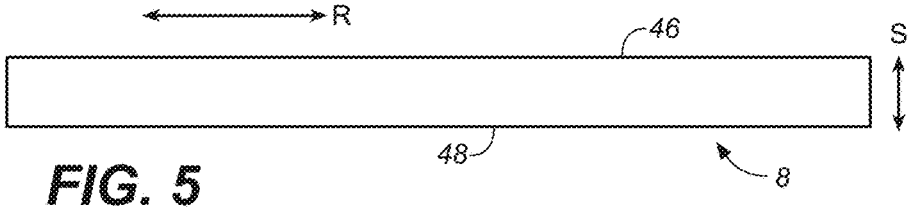
FIG. 5 is a top view of a stretching lever used for stretching a canvas sheet over a frame.
Figure 6:
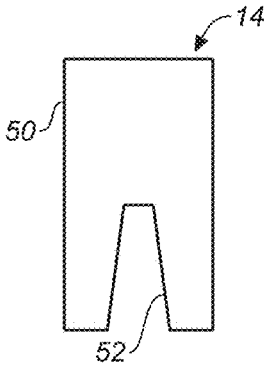
FIG. 6 is a cross sectional view of a lever clip that has a dual function. It is used to secure the edge of a canvas sheet to a stretching lever and it provides a handle for the stretching lever.

Kit 2 includes two stretching levers 810 and 820 that are different length embodiments of a stretching lever 8. Referring to FIGS. 2 and 5 each stretching lever 8 defines three mutually perpendicular axes including a major lever axis R, an intermediate lever axis S, and a minor lever axis T (not shown). Relative to major lever axis R the stretching levers 8 include a longer stretching lever 810 and shorter stretching lever 820. Each stretching lever 8 also includes an upper edge 46 and a lower edge 48 that are opposed relative to intermediate lever axis S. Kit 2 also includes lever clips 14 depicted in FIGS. 2 and 6. FIG. 6 depicts a lever clip 14 in cross section view. Each lever clip 14 includes an outer handle portion 50 and defines a tapered notch 52.

Referring to FIG. 2, the stretching levers 8 are each sized so as to span nearly the entire length of their respective stretcher bars. Longer stretching lever 810 spans nearly the entire length of lever recess 34 along major axis X of longer stretcher bars 410 and 430. This allows the canvas to be uniformly tensioned and stretched during use of the stretching lever. In one embodiment the length of longer stretching lever 810 along the major lever axis R is at least 60 percent, at least 70 percent, at least 80 percent, or at least 90 percent of the available length of lever recess 34 along axis X of each of stretcher bars 410 and 430.

Likewise and for the same reason shorter stretching lever 820 spans nearly the entire length of lever recess 34 along major axis X of shorter stretcher bars 420 and 440. In one embodiment the length of shorter stretching lever 820 along the major lever axis R is at least 60 percent, at least 70 percent, at least 80 percent, or at least 90 percent of the available length of lever recess 34 along axis X of each of shorter stretcher bars 420 and 440. The use of both longer 810 and shorter 820 stretching levers allows the stretching lever 8 lengths to be optimized for stretching the canvas relative to the different lengths of the stretcher bars 4.

In the illustrated embodiment the kit includes three lever clips 14. This allows the coupling of the canvas sheet 12 to the each stretching lever 8 to be distributed along lever axis R. This takes advantage of the length of the stretching lever 8 and assures a more uniform stretching of canvas sheet 12. In alternative embodiments there can be more or less lever clips 14.

Kit 2 also includes instructions 10 (FIG. 1) for assembling a canvas frame from the kit 2. The instructions 10 may be in paper form, electronic form, and/or any other suitable form. For example, instructions 10 may include a video file stored upon a flash drive.

Figure 7:
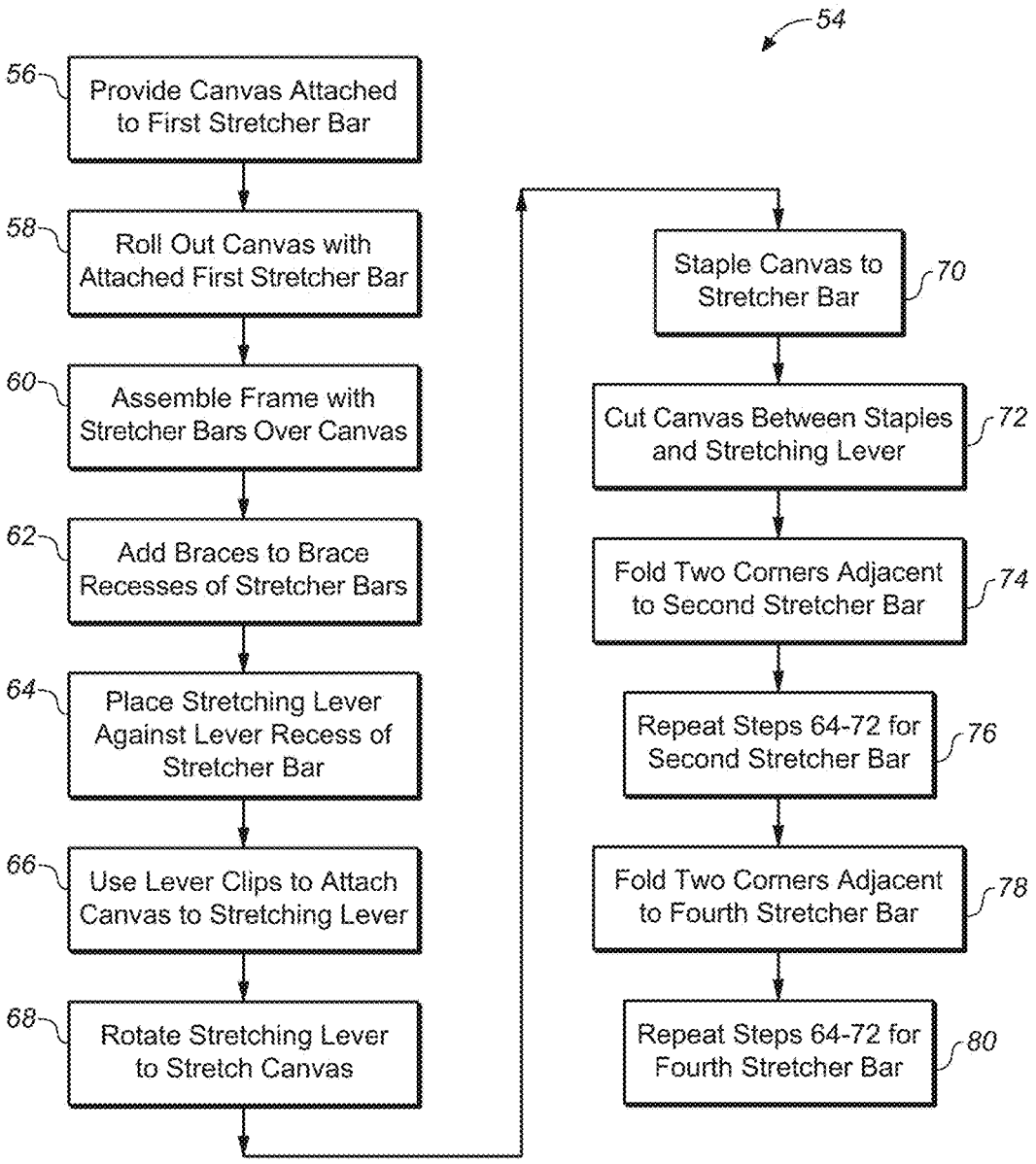
FIG. 7 is a flow chart representation of a process for assembling a canvas frame.

FIG. 7 is a flowchart illustrating an exemplary method 54 for utilizing kit 2 to assemble a canvas frame. Exemplary method 54 includes steps 56-80. Figures that follow FIG. 7 include illustrations intended to illustrate steps 56-80 of method 54.

According to step 56 a canvas sheet 12 is provided attached to a first stretcher bar 410. In this exemplary embodiment kit 2 includes the stretcher bar 410 pre-attached to canvas sheet 12.

Figure 8A:
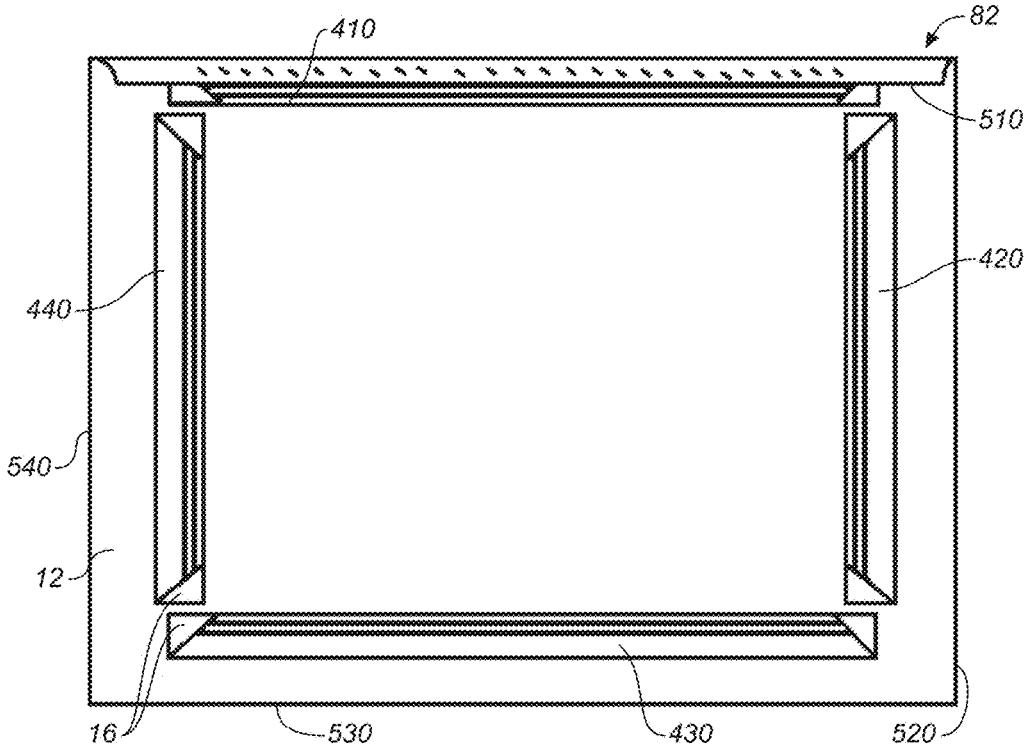
FIG. 8A is an illustration partly depicting step 60 of the flow chart from FIG. 7.
Figure 8B:
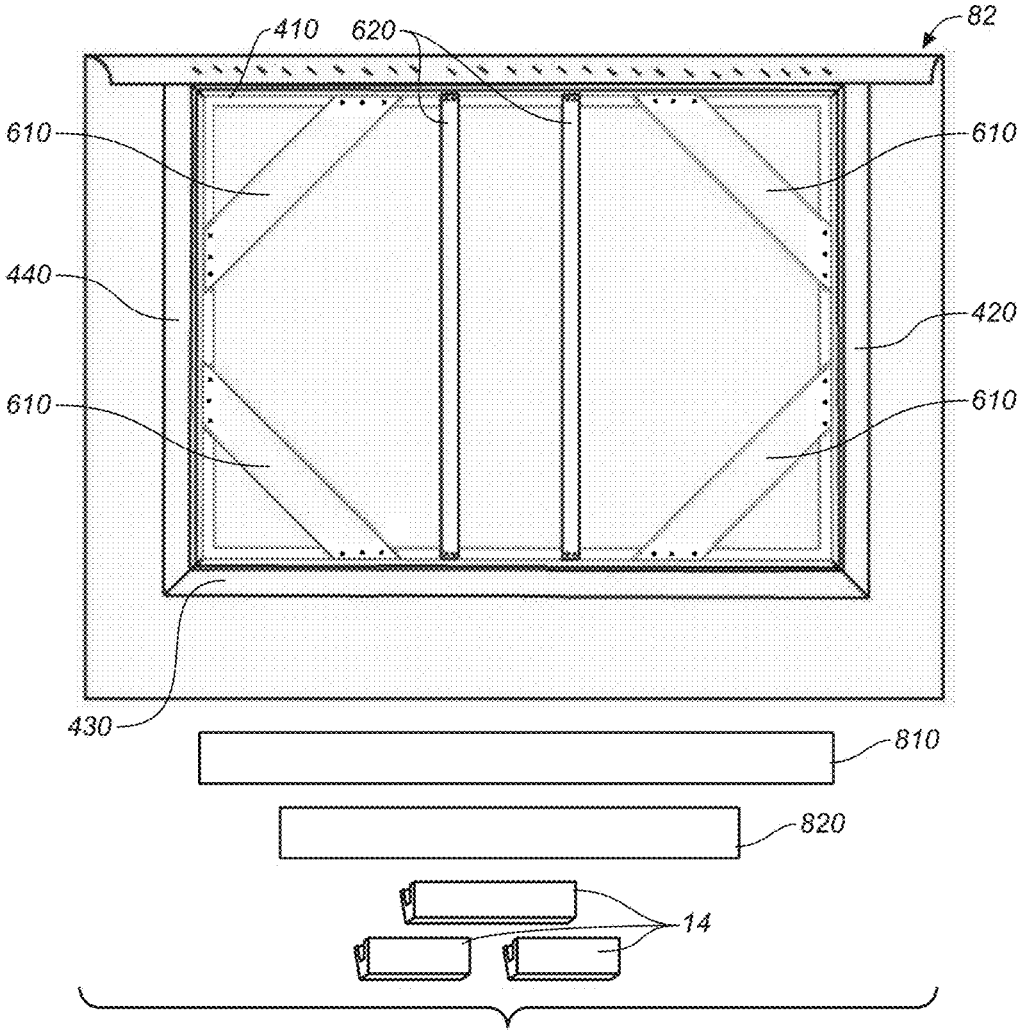
FIG. 8B is an illustration partly depicting a partly assembled frame after corner braces and cross braces have been attached.

According to step 58 a user of kit 2 rolls out the canvas 12 attached to first stretcher bar 410. According to step 60 the user assembles a frame 82 with stretcher bars 4 over canvas 12. FIG. 8A depicts the first stretcher bar 410 already attached to a first edge 510 of canvas sheet 12. Second stretcher bar 420, third stretcher bar 430, and fourth stretcher bar 440 have been arranged for assembly with connecting ends 16 in position for mutual coupling. Second stretcher bar 420 is proximate to second edge 520 of canvas sheet 12. Third stretcher bar 430 is proximate to third edge 530 of canvas sheet 12. Fourth stretcher bar 440 is proximate to fourth edge 540 of canvas sheet 12. FIG. 8B depicts frame 70 after connecting ends 16 have been mutually coupled according to step 60 of FIG. 7.

First 410 and second 420 stretcher bars are adjacent to each other. Second 420 and third 430 stretcher bars are adjacent to each other. Third 430 and fourth 440 stretcher bars are adjacent to each other. Fourth 440 and first 410 stretcher bars are adjacent to each other. Each adjacent pair (e.g., 410 and 420) of stretcher bars 4 include complementary connecting ends 16 for end to end coupling.

First 410 and third 430 stretcher bars are in opposing locations across frame 82. Second 420 and fourth 440 stretcher bars are in opposing locations across frame 82. The opposing pairs of stretcher bars (e.g., 410 and 430) are placed so that a vertical surface (e.g., lever recess vertical surface 22) of one opposing stretcher bar (e.g., 430) faces the opposing stretcher bar (e.g., 410). The opposing pairs of stretcher bars (e.g., 410 and 430) are in an opposing relationship relative to intermediate bar axis Y for each of the stretcher bars 4.

According to step 62 of FIG. 7 braces 6 are attached to brace recess horizontal surfaces 32 of stretcher bars 4. The placement of the braces 6 including corner braces 610 and cross braces 620 is illustrated in FIG. 8B.

Each corner brace 610 is placed so that opposing angular ends 42 rest upon brace recess horizontal surfaces 32 of adjacent stretcher bars 4. Next, a drill or screw driver is utilized to drive screws through screw holes 44 and into the brace recess horizontal surfaces 32. In this way stretcher bar 410 is joined to stretcher bar 420, stretcher bar 430 is joined to stretcher bar 440, stretcher bar 440 is joined to stretcher bar 410, and stretcher bar 420 is joined to stretcher bar 430. The corner braces also assure that adjacent stretcher bars (e.g., 410 and 420) are disposed at right angles to one another. When a corner brace is installed between two adjacent stretcher bars 4, the opposing angular ends 42 engage the brace recess vertical surfaces 30 of the two adjacent stretcher bars. This engagement assures that the adjacent stretcher bars 4 are disposed whereby the major bar axis X of one adjacent stretcher bar (e.g., 410) is at a right angle relative to the major bar axis of another adjacent stretcher bar (e.g. 420).

Cross braces 620 are attached to the brace recess horizontal surfaces 28 of opposing stretcher bars 4. Opposing stretcher bars are those in an opposing geometrical position relative to frame 82. In the illustrated embodiment two cross braces 620 are being utilized to join stretcher bar 410 to opposing stretcher bar 430.

Figure 8C:
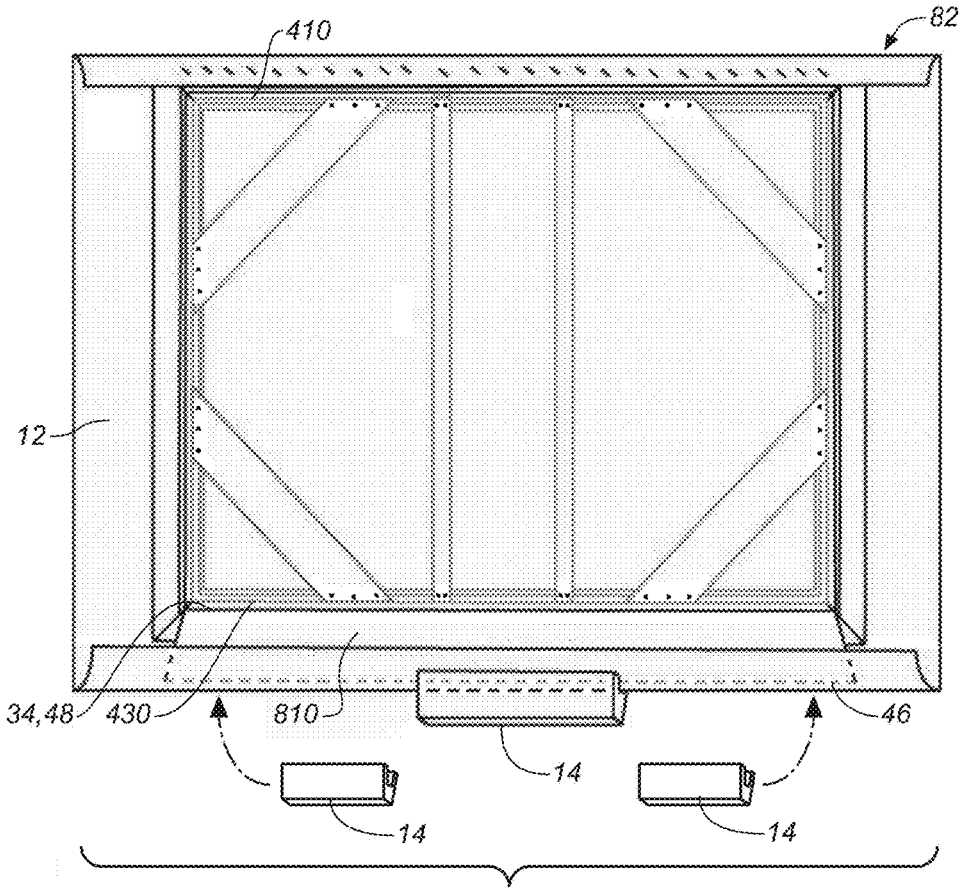
FIG. 8C is an illustration depicting a partly assembled frame just before a sheet stretching operation.
Figure 9A:
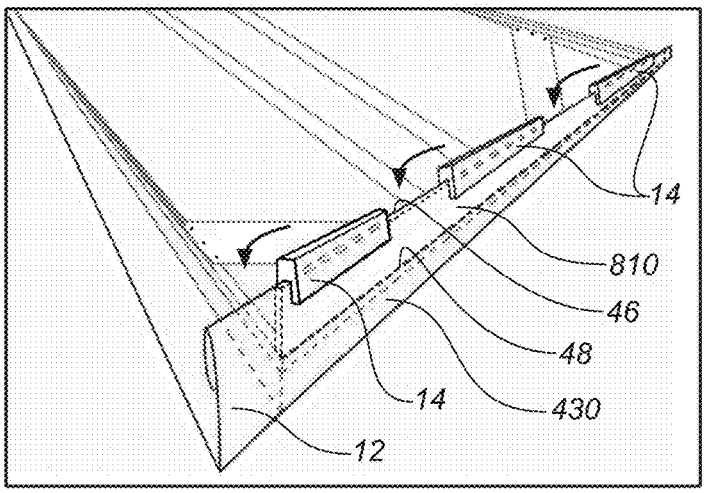
FIG. 9A is an isometric illustration depicting an initial position of a sheet stretching operation.
Figure 9B:
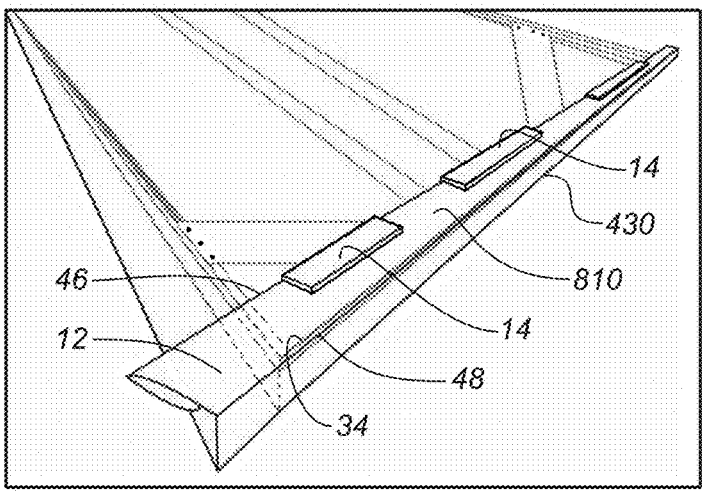
FIG. 9B is an isometric illustration depicting a final position of a sheet stretching operation.
Figure 9C:
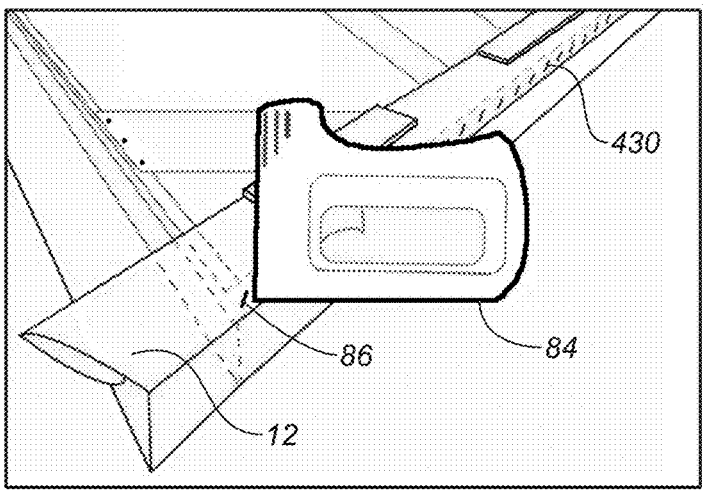
FIG. 9C is an isometric illustration depicting the stapling of a sheet to a third stretcher bar.
Figure 10A:
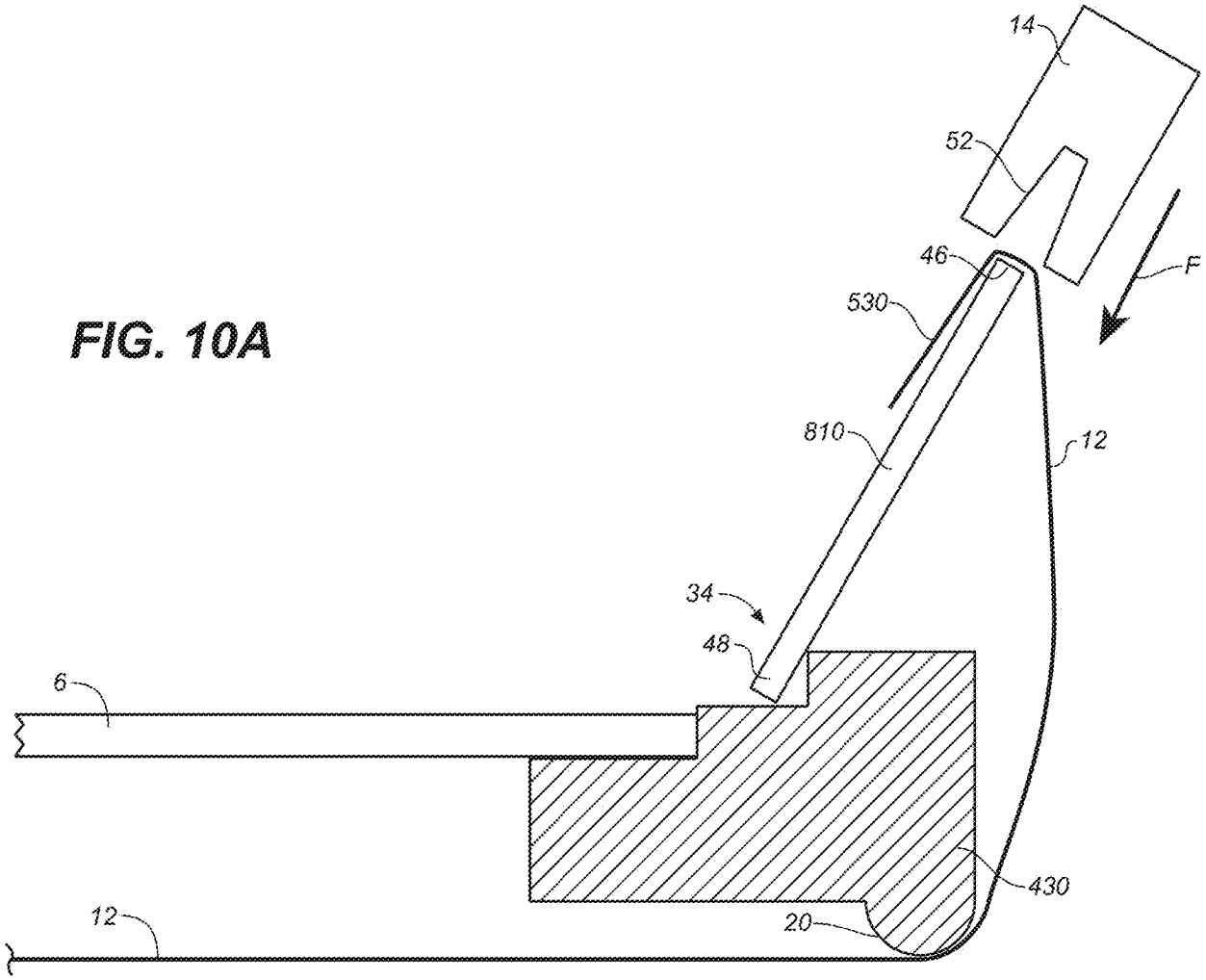
FIG. 10A is a cross sectional illustration of a process of stretching a sheet with the sheet having been folded over a stretching lever.

Steps 64-70 are further illustrated in FIG. 8C, FIGS. 9A-C, and FIGS. 10A-D. According to step 64 of FIG. 7 a lower edge 48 of stretching lever 810 is placed within lever recess 34 of stretcher bar 430. Lower edge 48 of stretching lever 810 engaging the lever recess 34 provides a fulcrum for stretching lever 810. Step 64 is illustrated in FIGS. 8C and 10A. Referring particularly to FIG. 10A, lower edge 48 of stretching lever 810 is shown placed within lever recess 34.

Figure 10B:
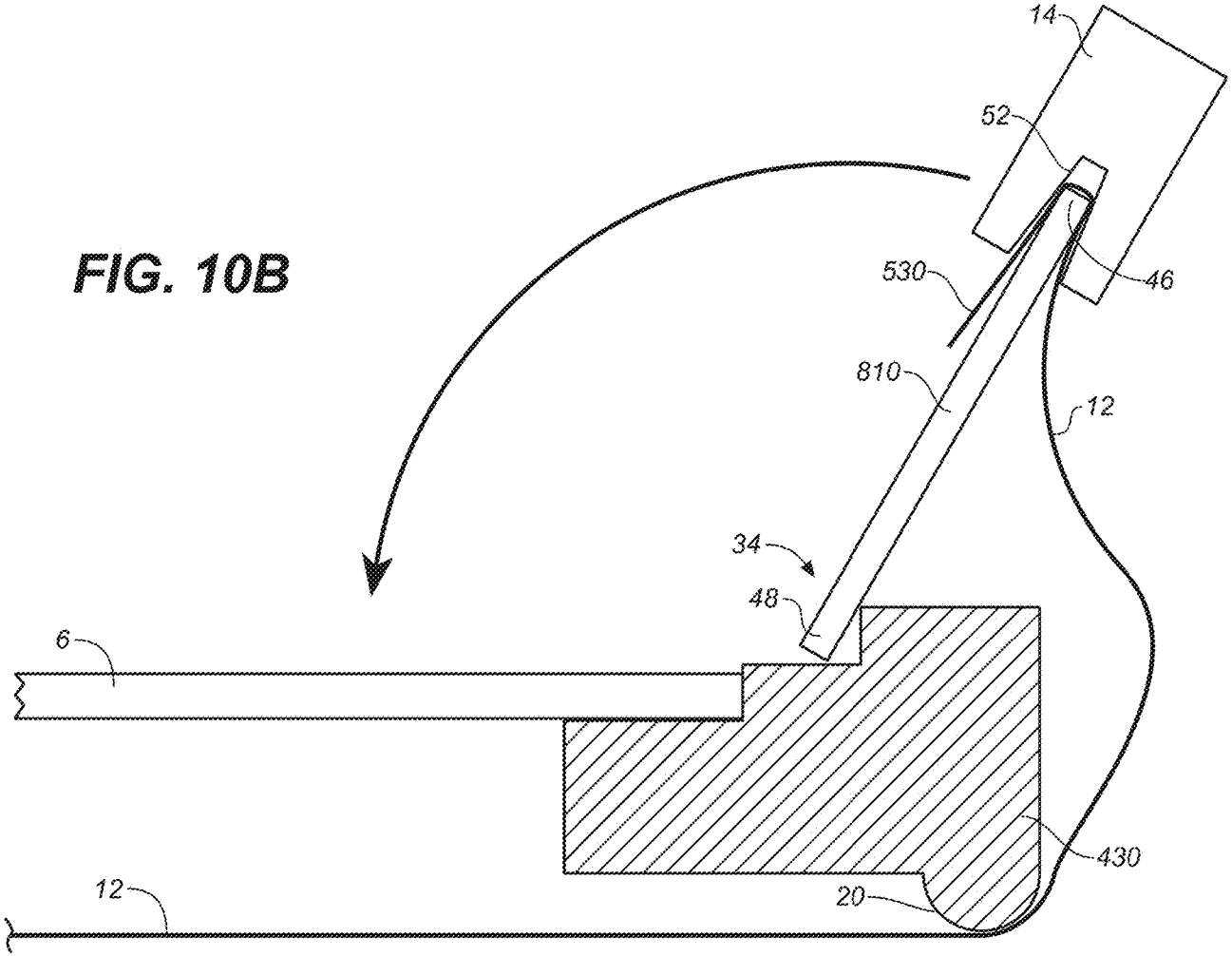
FIG. 10B is a cross sectional illustration of a process of stretching a sheet with the sheet attached to a stretching lever using a lever clip.

Next according to step 66 the third edge 530 of canvas sheet 12 adjacent to stretcher bar 430 is folded over the upper edge 46 of stretching lever 810. Also according to step 66, lever clips 14 are used to secure the third edge 530 of canvas sheet 12 to the upper edge 46 of stretching lever 810. Step 66 is illustrated in FIGS. 8C, 10A, and 10B. Referring to FIG. 8C it can be seen that three lever clips 14 are distributed along the length of major lever axis R of stretching lever 810. As illustrated a relatively longer lever clip 14 is placed at a center portion of stretching lever 810. Each of two relatively shorter lever clips 14 are positioned adjacent to the ends of stretching lever 810. This is important to provide a uniform stretching of canvas sheet 12 during step 68. The uniform stretching provides an advantage over some prior art manual stretching methods that are not over the entire length or width of the sheet and therefore require a very time consuming "iterative" approach to provide proper canvas stretching.

FIG. 10A depicts the third edge 530 of canvas sheet 12 being folded over the upper edge 46 of stretching lever 810. An arrow in FIG. 10A depicts a positioning of lever clip 14 as it is displaced along the intermediate lever axis S toward the upper edge 46. FIG. 10B depicts lever clip 14 placed to secure the third edge 530 of canvas sheet 12 to the upper edge 46 of stretching lever 810. In FIG. 10B the third edge 530 of canvas sheet 12 is sandwiched between tapered notch 52 and the upper edge 46 of stretching lever 810. Once lever clip 14 is thus deployed, it provides a dual function—it secures the third edge 530 of the canvas 12 to the upper edge 46 and it provides a handle 50 for rotating the upper edge 46 of stretching lever 810 about edge lower 48.

According to step 68 of FIG. 7, the upper edge 46 of stretching lever 810 is rotated about the fulcrum defined at lower edge 48 to tension the canvas 12 thereby. The rotation is inward relative to frame 82—toward the opposing stretcher bar 410. Step 68 is best illustrated in FIGS. 9A, 9B, 10B, 10C, and 10D. FIGS. 9A and 9B illustrate the rotation sequence of stretching lever 810 in isometric from nearly vertical (9A) to nearly horizontal (9B). The stretching lever 810 spans essentially the entire length of the lever recess 34 formed in stretcher bar 430 thereby providing a uniform stretching of canvas sheet 12.

Figure 10C:
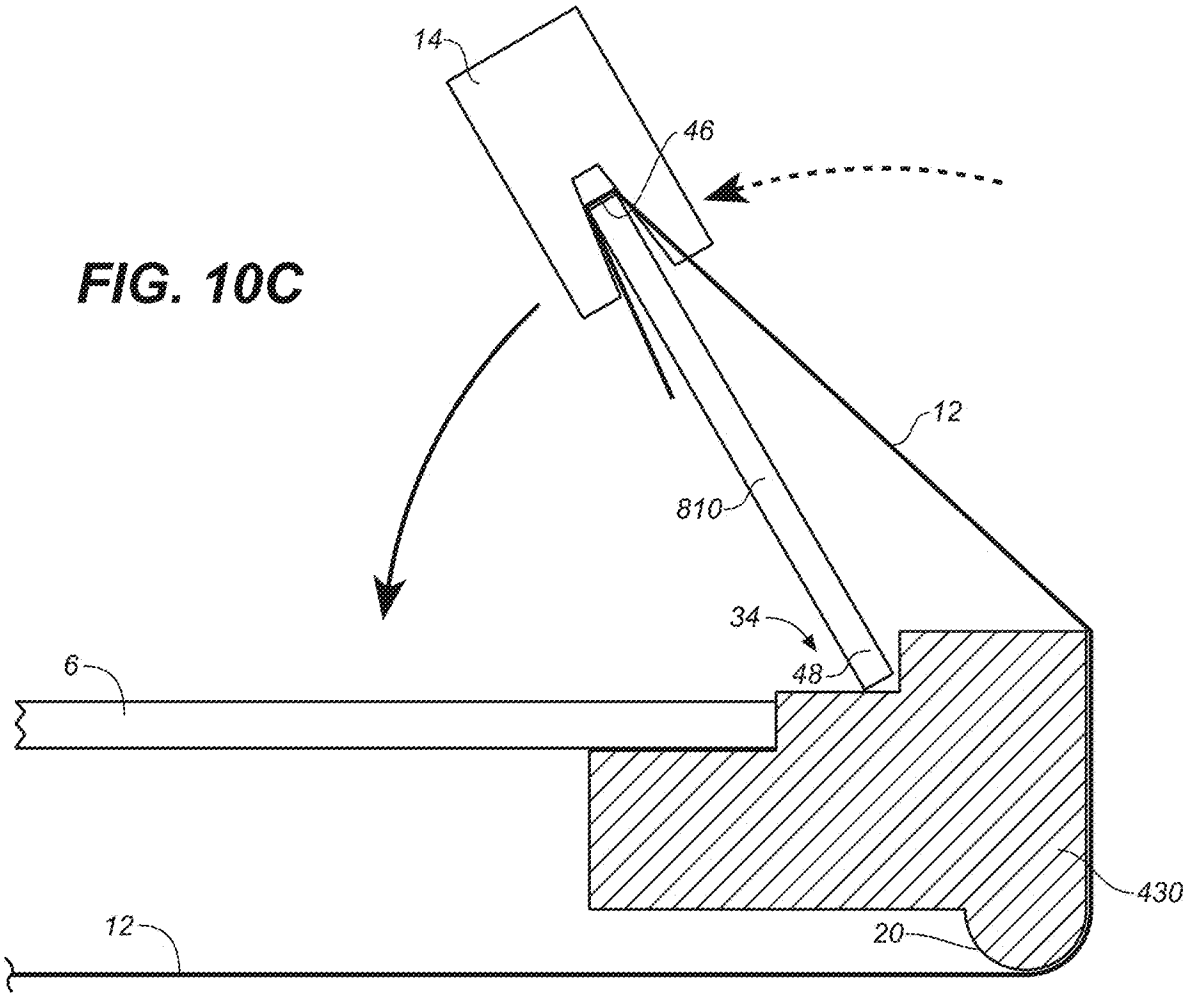
FIG. 10C is a cross sectional illustration of a process of stretching a sheet and depicting the motion of a stretching lever during the stretching process.
Figure 10D:
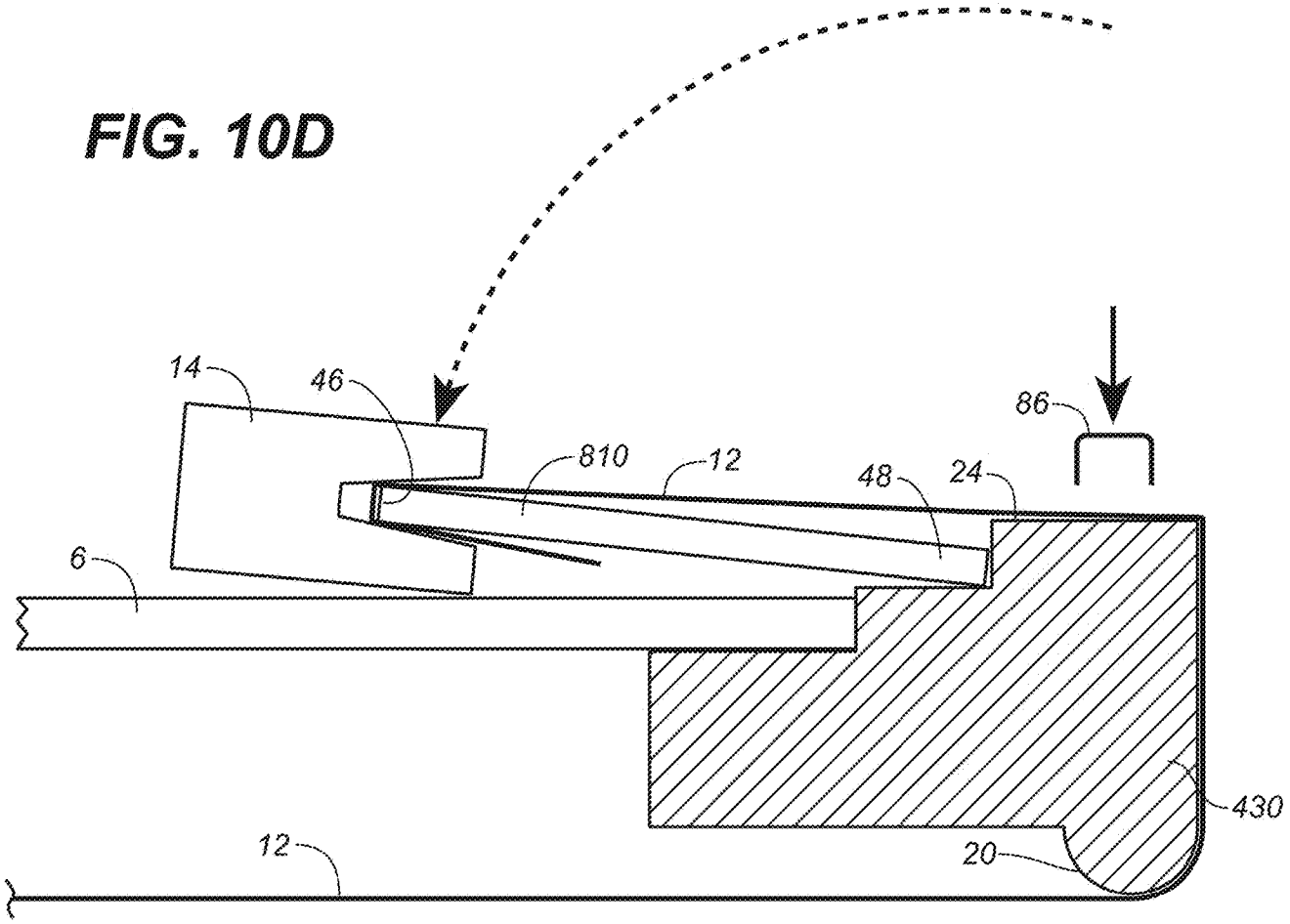
FIG. 10D is a cross sectional illustration of a process of stretching a sheet with the stretching lever fully rotated toward the first stretcher bar and a staple to be inserted to attach the sheet to a third stretcher bar.

FIGS. 10B, 10C, and 10D illustrate the rotation sequence of stretching lever 810 in cross section. The engagement of lower edge 48 with lever recess 34 defines a fulcrum for stretching lever 810. The upper edge 46 of stretching lever is rotated toward stretcher bar 410 about the lower edge 48. During rotation the lower edge 48 engages the vertical 26 and horizontal 28 surfaces of lever recess 34 (see also FIG. 3). During this rotation a user can grasp outer handle portion 50 of lever clip 14. During this rotation the canvas 12 is tensioned across the rounded extending portions 20 of the opposing stretcher bars 410 and 430. The canvas sheet is wrapped around extended portion 20, outer surface 38, and upper edge 46 of stretching lever 810.

According to step 70 the user staples or otherwise attaches the canvas to top surface 24 of third stretcher bar 430. This is illustrated in FIGS. 9C and 10D. FIG. 9C illustrates a stapler 84 being used to attach canvas 12 to stretcher bar 430 in isometric. FIG. 10D illustrates a staple 86 being used to attach the third edge 530 of canvas sheet 12 to top surface 24 of stretcher bar 430 in cross section.

Figure 11:
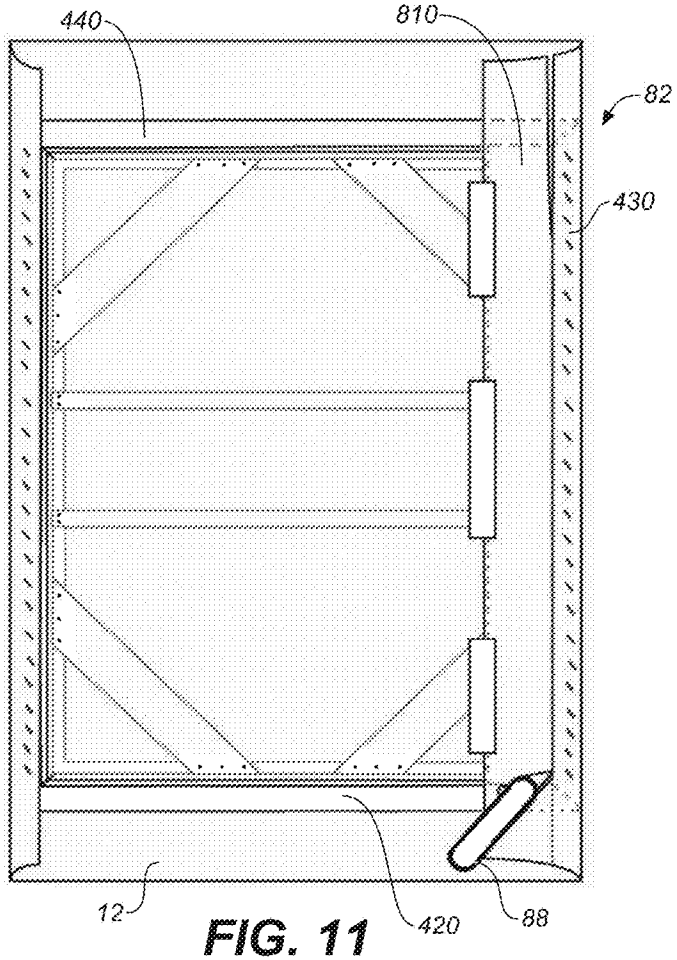
FIG. 11 is an illustration depicting cutting a sheet between a stretching lever and stretcher bar after the sheet has been stretched.

According to step 72 the user cuts the canvas between the staples in top surface 24 of stretcher bar 430 and the stretching lever 810 using cutter 88. This is illustrated in FIG. 11. Also according to step 72 the stretching lever 810 is removed from frame 82.

Figure 12A:
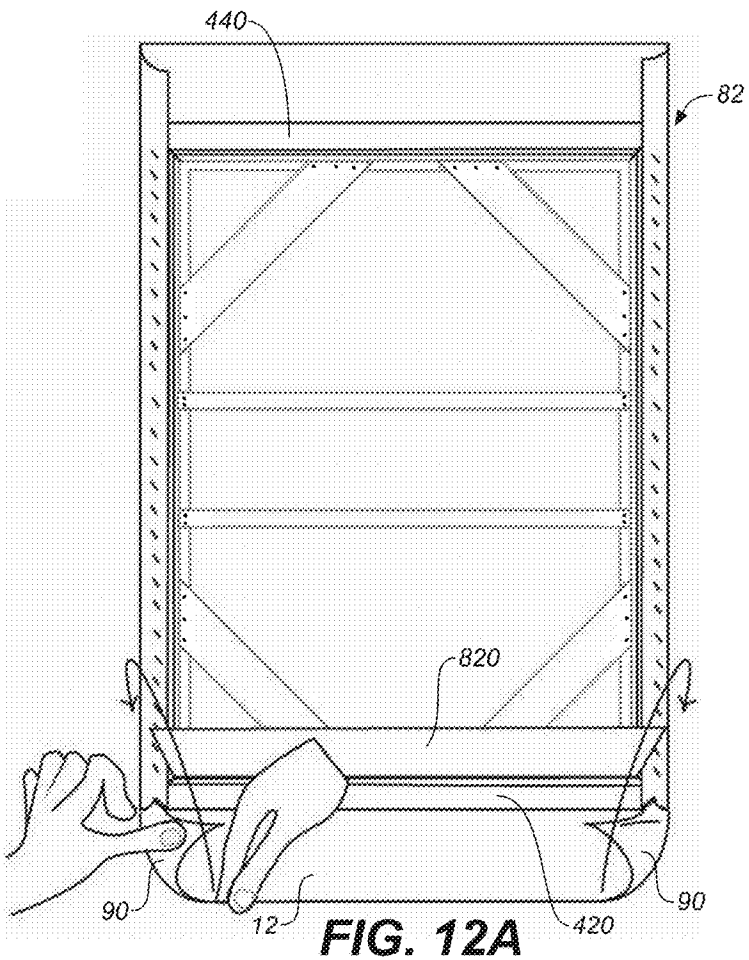
FIG. 12A is an illustration depicting the folding of the sheet at two corners adjacent to a second stretcher bar.

According to step 74 of FIG. 7 two corners 90 of canvas 12 adjacent to the second stretcher bar 420 are folded. Folding the corners 90 adjacent to stretcher bar 420 is illustrated in FIG. 12A.

Figure 12C:
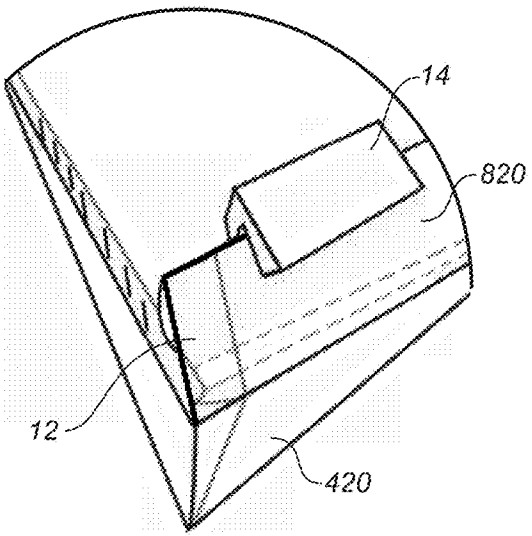
FIG. 12C depicts detail taken from FIG. 12B.
Figure 12B:
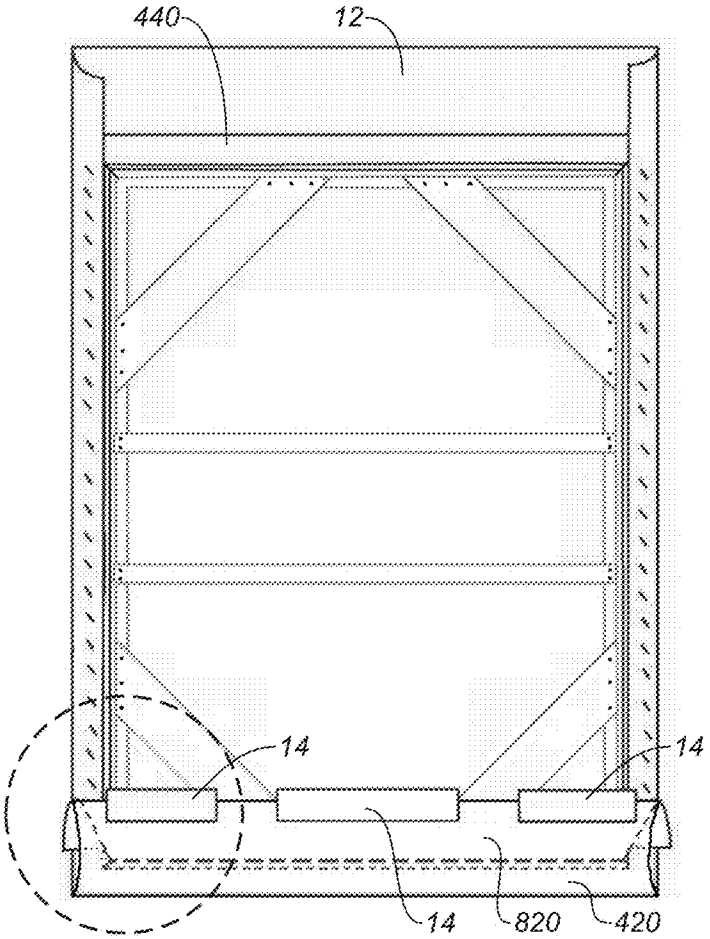
FIG. 12B is an illustration depicting stretching a sheet from a second stretcher bar.

According to step 76 of FIG. 7, the sequence of steps 64-72 are now essentially repeated to stretch canvas 12 at second stretcher bar 420. These steps differ from steps 64-72 in that shorter stretching lever 820 is utilized to accommodate the shorter length of second stretcher bar 420 relative to third stretcher bar 430. Otherwise, the steps are essentially the same. Step 76 is partially illustrated in FIGS. 12B and 12C.

According to step 78 of FIG. 7 the two corners adjacent to fourth stretcher bar 440 are folded. This is best accomplished with the frame 82 rotated so that fourth stretcher bar 440 is closest to the user.

According to step 80 of FIG. 7, the sequence of steps 64-72 are now essentially repeated to stretch canvas 12 at fourth stretcher bar 440 (but with shorter stretching lever 820 to accommodate shorter stretcher bar 440). After step 80 the assembly of canvas frame 82 is complete. Top and bottom views of completed frame 82 are illustrated in FIGS. 13A and 13B respectively.

Figure 13A:
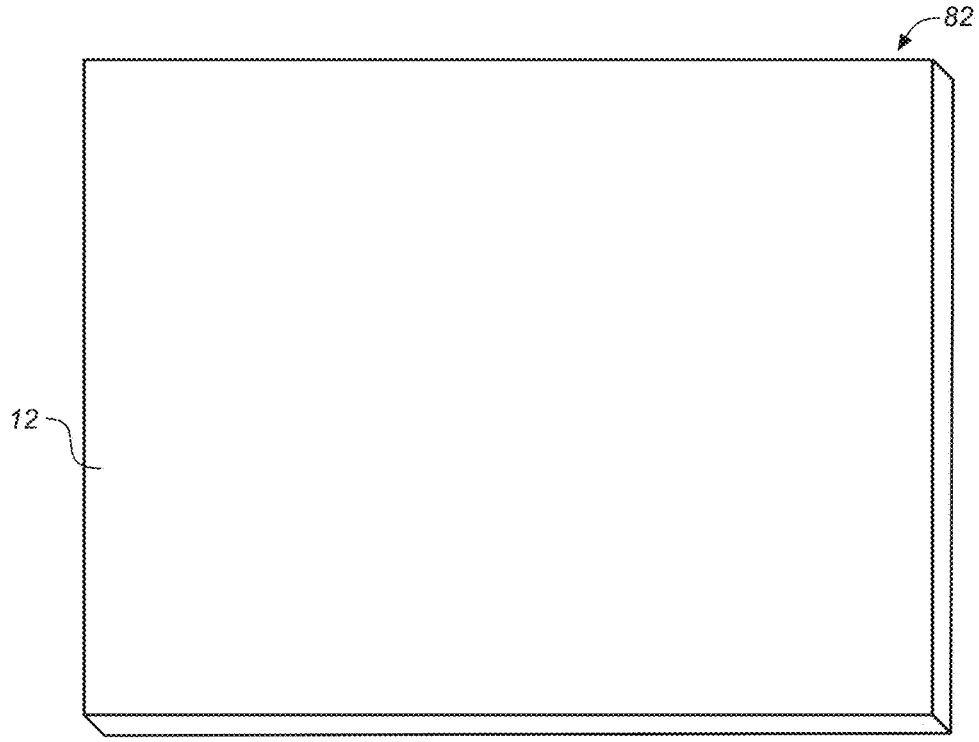
FIG. 13A depicts a top view of a fully assembled frame.
Figure 13B:
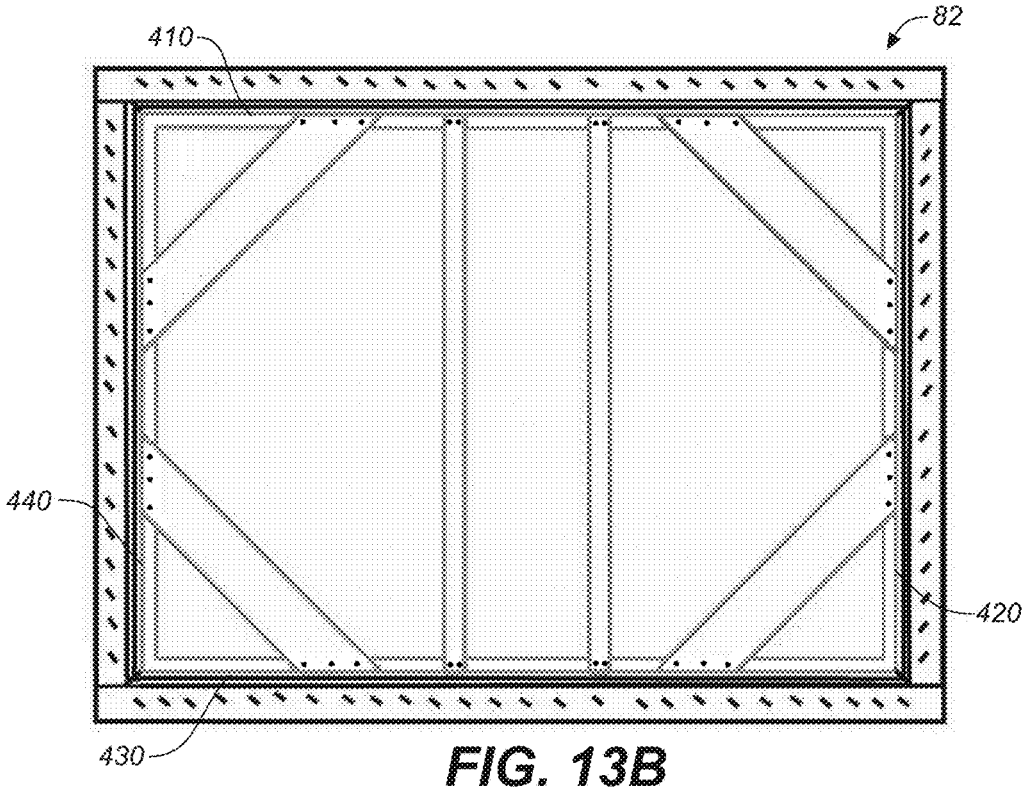
FIG. 13B depicts a bottom view of a fully assembled frame.

The frame 82 of FIGS. 13A and 13B can have a number of applications such as a picture frame. Alternatively frame 82 can be used for other purposes such as a headboard for a bed. Referring back to FIG. 2, other accessories 5 may be included such as brackets 5 for hanging the frame 82 as part or all of a headboard. Further, the kit can be all inclusive such that no additional tools are required for assembly.

Figure 14:
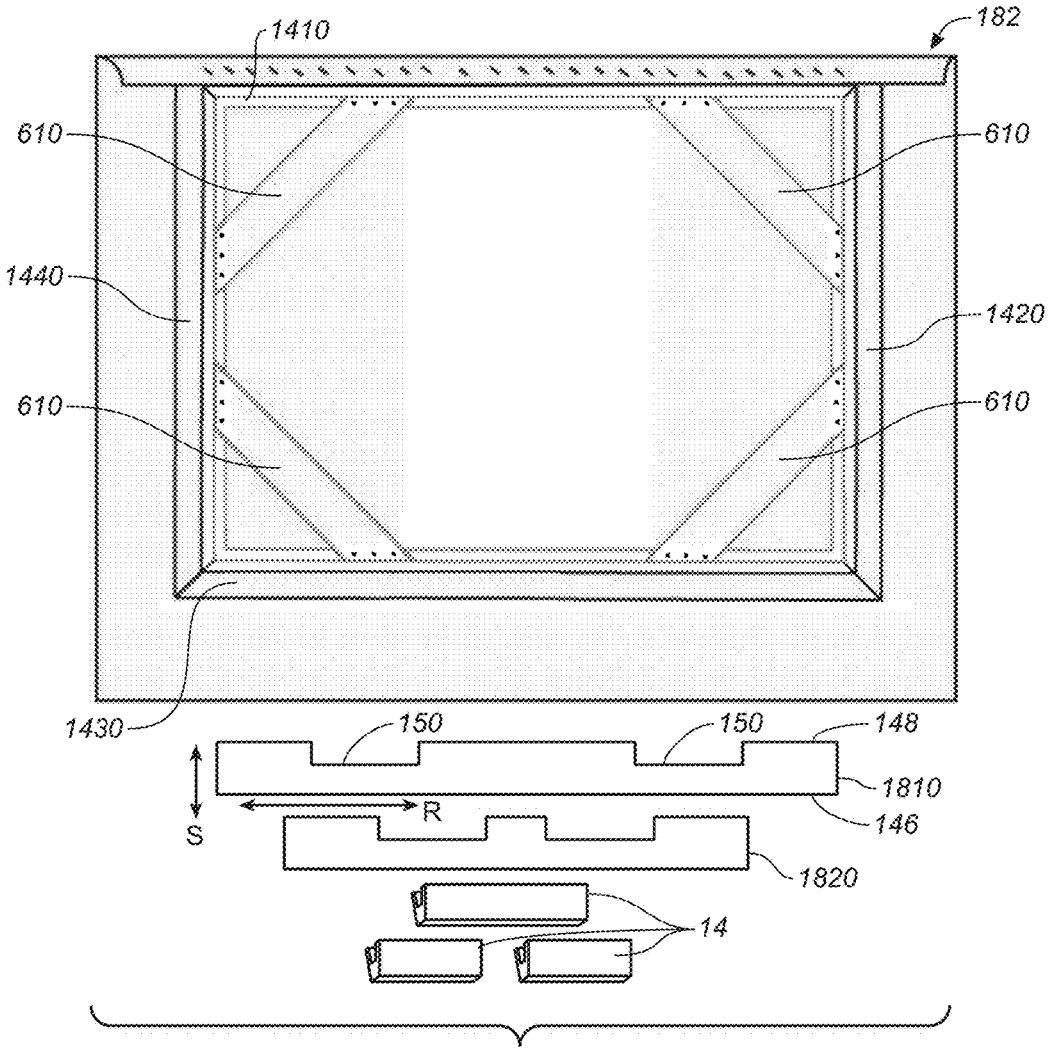
FIG. 14 is an illustration of an alternative embodiment of a partially assembled frame.
Figure 15:
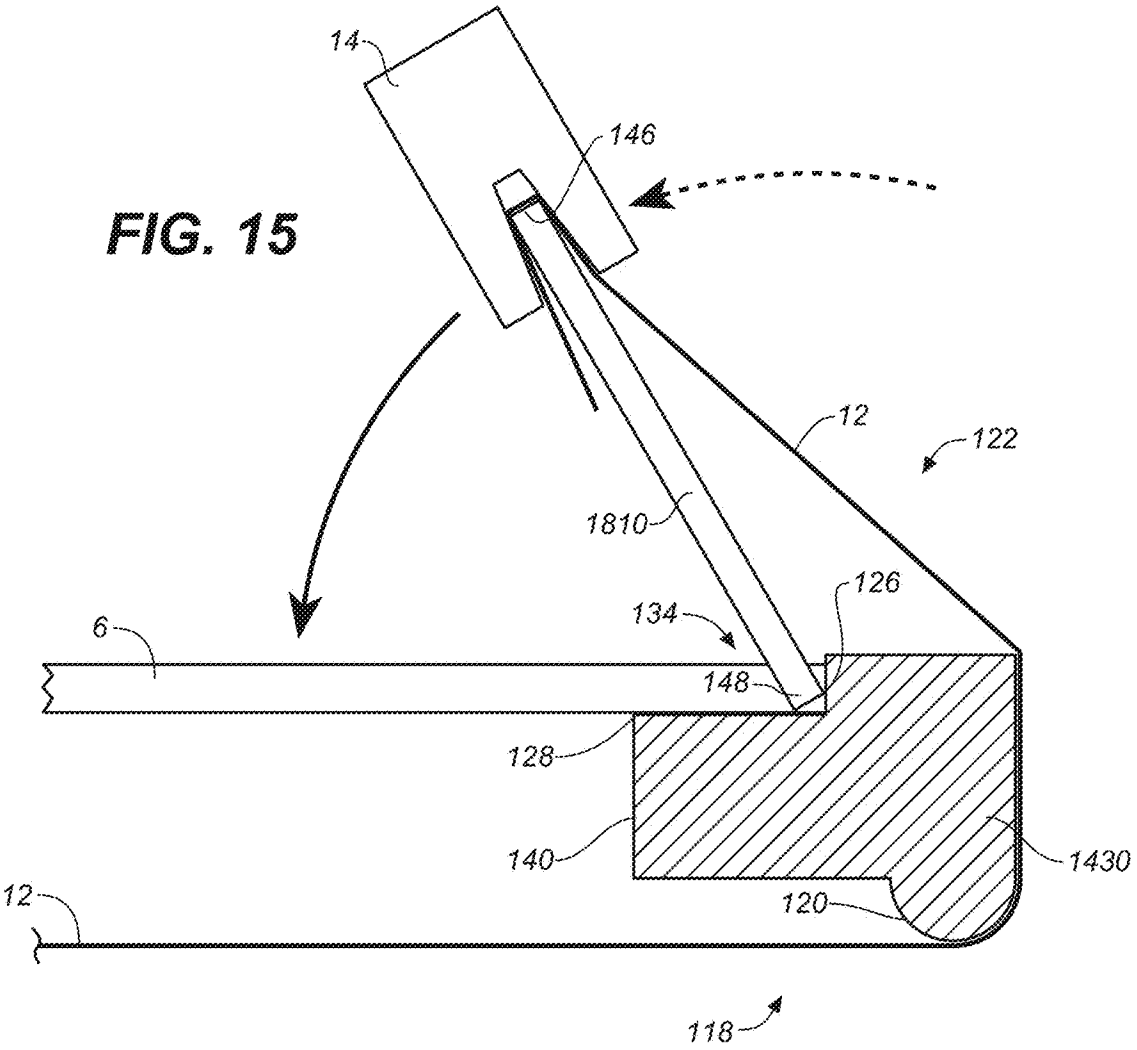
FIG. 15 is a cross sectional illustration depicting the stretching of a sheet for the frame of FIG. 14.

FIGS. 14 and 15 depict construction of frame 182 which is an alternative embodiment of frame 82. Like element numbers depict similar elements to those described with respect to FIGS. 1-13. However, frame 182 differs from frame 82 in terms of alternative embodiments of stretcher bars 4 and stretching levers 8.

Frame 182 is formed from four stretcher bars 1410-1440 including first stretcher bar 1410, second stretcher bar 1420, third stretcher bar 1430, and fourth stretcher bar 1440. The four stretcher bars 1410-1440 are arranged with stretcher bars 1410 and 1430 at opposite or opposing ends of frame 182. Also stretcher bars 1420 and 1440 are at opposite or opposing ends of frame 182.

FIG. 15 includes stretcher bar 1430 shown in cross section. Stretcher bar 1430 has lower surface 118 and opposing upper surface 122. Upper surface 122 that includes a single brace and lever recess 134. Brace and lever recess 134 includes vertical surface 126 and horizontal surface 128. Brace and lever recess 134 receives and engages the ends of braces 6 such as corner braces 610.

Also shown in FIG. 14 are notched stretching levers 1810 and 1820. Each notched stretching lever 1810 and 1820 includes an upper edge 146 and a lower edge 148 at opposing ends relative to intermediate lever axis S. The lower edge 148 includes notches 150 formed therein and arranged along the long lever axis R. Each notch has a width and position along long lever axis R to overlay a corresponding brace 6 utilized with frame 182. Each notch 150 has a sufficient depth as measured along intermediate lever axis S to clear its corresponding brace 6 when the lower edge 148 engages brace and lever recess 134. The lower edge 148 of illustrated notched stretching lever 1810 has two notches that have a depth, width, and position to clear two corner braces 610 that are coupled to third stretcher bar 1430. If cross brace(s) (not shown) were to be used, then additional corresponding notch(es) would be formed into the lower edge 148 of notched stretching lever 1810.

FIG. 15 depicts the use of notched stretching lever 1810 for stretching sheet 12. As can be seen, lower edge 148 forms a fulcrum where it engages brace and lever recess 134 for the rotation of notched stretching lever 1810. The notches 150 clear brace 6, allowing the brace and lever recess 134 to provide a dual function including the receipt and support of braces 6 and for providing the fulcrum location for notched stretching lever 1810. The stretching of sheet 12 depicted in FIG. 15 is very similar to that depicted in FIGS. 10A-D.

In yet another embodiment, the lower edge 148 of notched stretching levers 1810 and 1820 can also be used to engage inner vertical surface 140 of stretcher bar 1430. For such an embodiment, the notches 150 would need to have a greater depth as measured along intermediate lever axis S so as to clear the braces 6 and to allow the lower edge 148 to properly engage vertical surface 140. For such an embodiment, there may be no need for recesses such as brace and lever recess 134.

The specific embodiments and applications thereof described above are for illustrative purposes only and do not preclude modifications and variations encompassed by the scope of the following claims.

What we claim is:

1. A kit for assembling a frame with a stretched sheet comprising:

a sheet having an edge;

a set of four stretcher bars including first, second, third, and fourth stretcher bars to be assembled end to end to form a frame whereby the first and third stretcher bars define opposite sides of the frame, each stretcher bar having a lower surface to be disposed upon the sheet during assembly and an opposing upper surface, the third stretcher bar defining a vertical surface that faces the first stretcher bar;

a first stretching lever having opposing upper and lower edges, the lower edge to be placed against the vertical surface and the upper edge to be attached to the edge of the sheet whereby rotation of the upper edge toward the first stretcher bar tensions the sheet along a direction perpendicular to a major axis of the third stretcher bar wherein the upper surface of each stretcher bar includes a brace recess horizontal surface and further comprising: a set of cross braces for coupling the brace recess horizontal surfaces of the first and third stretcher bars.

2. The kit of claim 1 wherein the upper surface of each stretcher bar includes a brace recess and further comprising: a set of corner braces for coupling the brace recesses of adjacent stretcher bars together and assuring that the adjacent stretcher bars are substantially perpendicular to each other.

3. The kit of claim 1 wherein upper surface of the second stretcher bar defines a vertical surface and further comprising a second stretching lever having opposing upper and lower edges, the lower edge of the second stretching lever to be placed against the vertical surface of the second stretcher bar and the upper edge of the second stretching lever to be attached to a second edge of the sheet whereby rotation of the upper edge of the second stretching lever toward the fourth stretcher bar tensions the sheet along a direction perpendicular to a major axis of the second stretcher bar.

4. The kit of claim 1 further comprising a lever clip defining a tapered notch, the lever clip assembled to the first stretching lever whereby the tapered notch engages and secures the edge of the sheet to the upper edge of the stretching lever.

5. The kit of claim 1 wherein the upper surface of the third stretcher bar defines a lever recess that includes the vertical surface.

6. A method of assembling a frame with a stretched sheet comprising:

disposing a sheet on a surface with a first stretcher bar attached to a first edge of the sheet and a third edge of the sheet extending away from the first stretcher bar;

assembling first, second, third, and fourth stretcher bars in an end to end configuration to form a four sided frame whereby the first and third stretcher bars define opposite sides of the frame, the third stretcher bar having a lower surface disposed against the sheet and defining a vertical surface;

positioning a lower edge of a stretching lever against the vertical surface;

attaching the third edge of the sheet to an upper edge of the stretching lever;

rotating the upper edge of the stretching lever toward the first stretcher bar to tension the sheet; and attaching the tensioned sheet to the third stretcher bar wherein each stretcher bar includes a pair of complementary tongue and groove features at opposing ends and assembling the stretcher bars includes engaging the complementary tongue and groove features.

7. A method of assembling a frame with a stretched sheet comprising:

disposing a sheet on a surface with a first stretcher bar attached to a first edge of the sheet and a third edge of the sheet extending away from the first stretcher bar;

assembling first, second, third, and fourth stretcher bars in an end to end configuration to form a four sided frame whereby the first and third stretcher bars define opposite sides of the frame, the third stretcher bar having a lower surface disposed against the sheet and defining a vertical surface;

positioning a lower edge of a stretching lever against the vertical surface;

attaching the third edge of the sheet to an upper edge of the stretching lever;

rotating the upper edge of the stretching lever toward the first stretcher bar to tension the sheet;

and attaching the tensioned sheet to the third stretcher bar wherein each stretcher bar defines a brace recess horizontal surface and further comprising assembling a corner brace onto the brace recess horizontal surfaces of two adjacent stretcher bars before positioning the lower edge of the stretching lever thereby assuring that the adjacent stretcher bars are substantially perpendicular to each other.

8. A method of assembling a frame with a stretched sheet comprising:

disposing a sheet on a surface with a first stretcher bar attached to a first edge of the sheet and a third edge of the sheet extending away from the first stretcher bar;

assembling first, second, third, and fourth stretcher bars in an end to end configuration to form a four sided frame whereby the first and third stretcher bars define opposite sides of the frame, the third stretcher bar having a lower surface disposed against the sheet and defining a vertical surface;

positioning a lower edge of a stretching lever against the vertical surface;

attaching the third edge of the sheet to an upper edge of the stretching lever;

rotating the upper edge of the stretching lever toward the first stretcher bar to tension the sheet;

and attaching the tensioned sheet to the third stretcher bar wherein each stretcher bar defines a brace recess horizontal surface and further comprising assembling a cross brace onto the brace recess horizontal surfaces of two opposing stretcher bars before positioning the lower edge of the stretching lever.

9. The method of claim 6 wherein attaching the third edge of the sheet includes wrapping the sheet over the upper edge of the stretching lever and then using a lever clip to attach the sheet to the upper edge of the stretching lever.

10. The method of claim 9 wherein the lever clip defines a tapered notch and wherein attaching the sheet to the upper edge of the stretching lever includes capturing the sheet between the tapered notch and the upper edge of the stretching lever.

11. The method of claim 9 wherein a plurality of lever clips are used to improve uniformity of the tension in the sheet.

12. The method of claim 6 further comprising cutting the sheet between the third stretcher bar and the upper edge of the stretching lever.

13. The method of claim 6 further comprising folding the sheet at two corners adjacent to the second stretcher bar.

14. The method of claim 6 wherein the second stretcher bar defines a vertical surface and further comprising:

positioning a lower edge of a second stretching lever against the vertical surface;

attaching a second edge of the sheet to an upper edge of the second stretching lever;

rotating the upper edge of the second stretching lever toward the first stretcher bar to tension the sheet; and attaching the tensioned sheet to the third stretcher bar.

15. The method of claim 6 wherein the third stretcher bar defines a lever recess including the vertical surface.

16. A kit for assembling a frame with a stretched sheet comprising:

a sheet having an edge;

a set of four stretcher bars including first, second, third, and fourth stretcher bars to be assembled end to end to form a frame whereby the first and third stretcher bars define opposite sides of the frame, each stretcher bar having a lower surface to be disposed upon the sheet during assembly and an opposing upper surface, the third stretcher bar defining a vertical surface that faces the first stretcher bar;

a stretching lever having opposing upper and lower edges, the lower edge to be placed against the vertical surface and the upper edge to be attached to the edge of the sheet whereby rotation of the upper edge toward the first stretcher bar tensions the sheet along a direction perpendicular to a major axis of the third stretcher bar, each stretcher bar includes a pair of complementary tongue and groove features at opposing ends and assembling the stretcher bars includes engaging the complementary tongue and groove features.

17. The kit of claim 16 further comprising a lever clip defining a tapered notch, the lever clip assembled to the stretching lever whereby the tapered notch engages and secures the edge of the sheet to the upper edge of the stretching lever.

18. The kit of claim 16 wherein the upper surface of the third stretcher bar defines a lever recess.

19. A kit for assembling a frame with a stretched sheet comprising:

a sheet having an edge;

a set of four stretcher bars including first, second, third, and fourth stretcher bars to be assembled end to end to form a frame whereby the first and third stretcher bars define opposite sides of the frame, each stretcher bar having a lower surface to be disposed upon the sheet during assembly and an opposing upper surface, the third stretcher bar defining a vertical surface that faces the first stretcher bar;

a stretching lever having opposing upper and lower edges, the lower edge to be placed against the vertical surface and the upper edge to be attached to the edge of the sheet whereby rotation of the upper edge toward the first stretcher bar tensions the sheet along a direction perpendicular to a major axis of the third stretcher bar, each stretcher bar defines a brace recess horizontal surface and further comprising assembling a corner brace onto the brace recess horizontal surfaces of two adjacent stretcher bars before positioning the lower edge of the stretching lever thereby assuring that the adjacent stretcher bars are substantially perpendicular to each other.

20. The kit of claim 19 further comprising a lever clip defining a tapered notch, the lever clip assembled to the stretching lever whereby the tapered notch engages and secures the edge of the sheet to the upper edge of the stretching lever.

21. The kit of claim 19 wherein the upper surface of the third stretcher bar defines a lever recess.

* * * * *